United States Patent [19]

Connor

[11] 3,963,215

[45] June 15, 1976

[54] NAIL EXTRACTOR TOOL

[76] Inventor: Harry F. Connor, 3066 Alviena Drive, San Jose, Calif. 95133

[22] Filed: Oct. 28, 1975

[21] Appl. No.: 625,936

[52] U.S. Cl. ..... 254/26 R
[51] Int. Cl.[2] ..... B66F 15/00
[58] Field of Search ..... 254/21, 24, 25, 26, 254/18

[56] References Cited

UNITED STATES PATENTS

| | | | |
|---|---|---|---|
| 1,199,948 | 10/1916 | Walton | 254/24 |
| 1,445,514 | 2/1923 | Johnson | 254/21 |
| 1,454,239 | 5/1923 | Kawamura | 254/25 |
| 1,713,810 | 5/1929 | Andersen | 254/26 |
| 2,382,831 | 8/1945 | Tabellione | 254/25 |

*Primary Examiner*—Al Lawrence Smith
*Assistant Examiner*—Robert C. Watson
*Attorney, Agent, or Firm*—Leslie M. Hansen

[57] ABSTRACT

A hand tool having a leverage handle from which a nail pulling foot portion extends laterally from one end thereof and has a bore formed therein from its extreme lateral end toward the handle for receiving a portion of a nail, the balance of which is embedded below the surface of a member from which it is to be extracted by movement of the handle in a direction to first bend such nail into a snubbing relation to the bore in which it is lodged, the foot portion of the tool having an arcuate contoured face rockable upon the surface from which the nail is to be extracted. The tool further having slits formed in that face thereof opposite the arcuate surface into communication with the bore formed in the foot portion for register and receipt of the head of a flat headed nail during the bending and pulling operation of the tool. This feature also provides a safety feature by preventing the nail from flipping out of the bore when the nail comes loose from the surface out of which it is pulled.

3 Claims, 7 Drawing Figures

NAIL EXTRACTOR TOOL

This invention relates to nail pullers and more particularly to a nail extractor tool.

BACKGROUND

Various forms of nail pullers are well known in the art. The claw hammer, pinch bar, and hatchets with a V groove recess formed on one side edge of its blade are the most common. The greatest problem in the pulling of nails resides in the fact that most nail pullers rely on the head of the nail sustaining the pull. However, when a well seated nail fails to come out easily, the head of such nail is flexed and bent out of shape, straightened out, and slipped through the claw of the pulling device. Thereafter such means for pulling the nail is useless. The nail would have to be pulled by means of a pincer for grasping the shank of the nail.

There are forms of nail pullers, other than pincers by which the shank of a nail is engaged for and during the pulling operation. U.S. Pat. No. 1,445,514 to Johnson shows a stepped slot for grasping the shank of different sized nails. With such structure, slip outs are possible. U.S. Pat. No. 1,199,948 to Walton shows a hammerhead provided with a bore parallel the hammer handle for receiving a portion of a nail to be pulled and a spring loaded wedge in the bore for urging the head end of such nail against a roughened wall in the bore. While the spring loaded wedge prevents slip-out of the nail, it will be appreciated that the Walton puller is quite complex as well as difficult and expensive to manufacture.

The present invention seeks to overcome such deficiencies and characteristics of construction and operation by a simple structure, economical to manufacture and highly efficient in use.

STATEMENT OF THE INVENTION

This invention contemplates the provision of a hand tool in which a lever has a lateral foot provided with a surface tangent to an arcuate base and having a bore formed parallel to the foot and at one end of the latter to receive a portion of a nail extending from a surface from which the nail is to be pulled.

It is an object of such hand tool to provide a means for first bending the extended portion of such nail to a condition substantially at right angles to the shank of the nail embedded in such surface for snubbing the nail head portion within the bore and thereafter utilizing the arcuate base of the tool for rocking the lateral foot on such surface to raise the nail out of such surface.

It is another object to provide lateral foot of such hand tool with transverse slots on the surface thereof opposite that which is tangent to the arcuate base, the slots communicating with the bore for engaging the head of a nail in the latter.

These and other objects and advantages of the present invention will become apparent in the following description and claims when read in the light of the accompanying single sheet of drawing in which:

GENERAL DESCRIPTION

Figures 1, 2, 3, 4, 5, 6, 7:
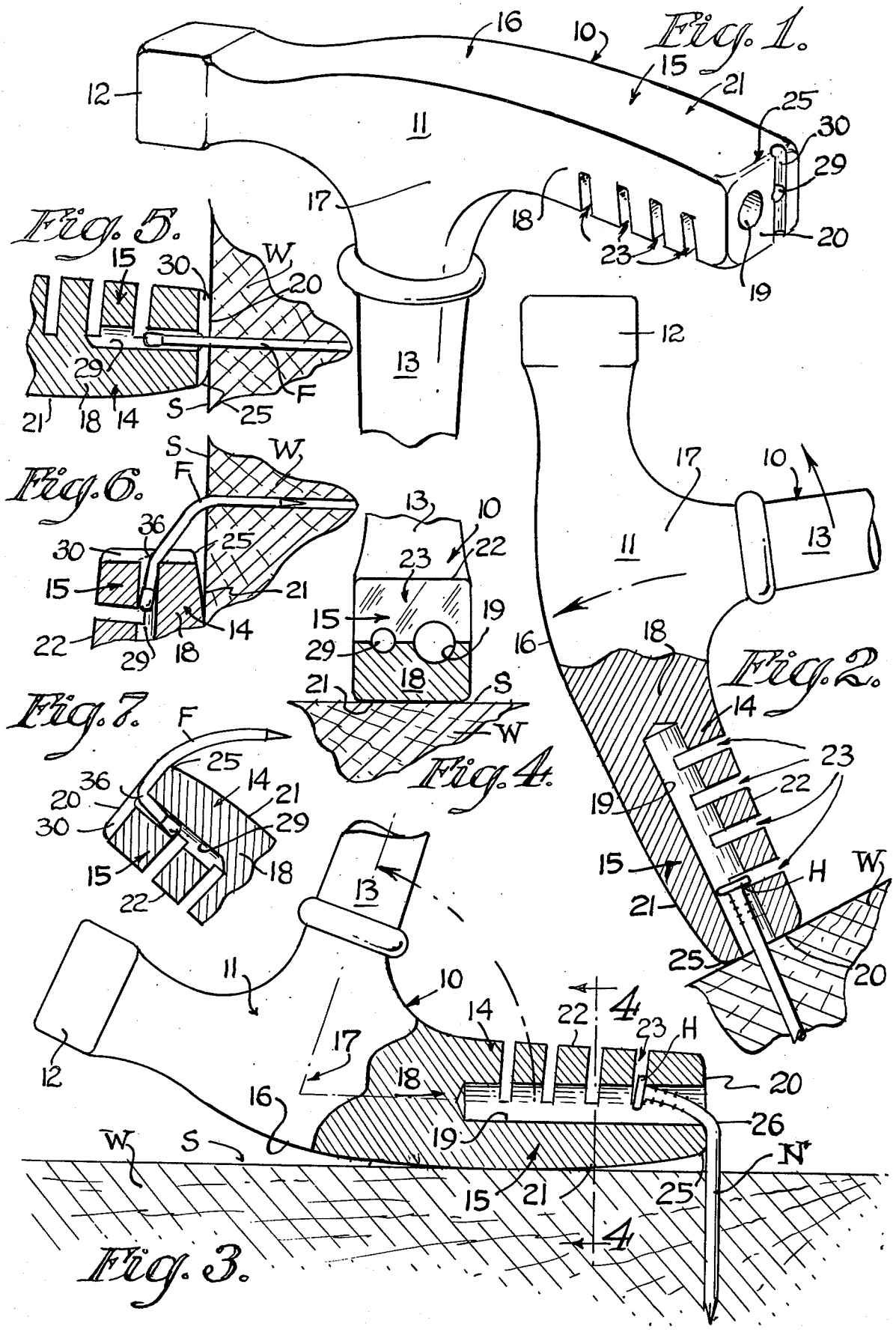
FIG. 1 shows the nail extractor embodied in the head of a tool.
FIG. 2 shows the extractor in section and mounted on a nail to be pulled.
FIG. 3 shows the head of the nail engaged in one of the slots in the puller, the nail being bent over in a snubbing action during the pulling operation.
FIG. 4 is a cross section through the puller taken along line 4—4 in FIG. 3.
FIG. 5 is a fragmentary section through the puller showing a finishing nail about to be pulled.
FIG. 6 shows the puller of FIG. 5 rocked anticlockwise therefrom to snub the finishing nail during the pulling operation.
FIG. 7 is an illustration of the puller of FIGS. 5 and 6 with a completely extracted finishing nail therein.

In the drawings, the nail extractor tool generally designated 10 is embodied in the head 11 of a hammer 12 which forms a T-shape relative to a handle 13 in the conventional manner. As illustrated, the nail extracting feature 14 of the present invention is embodied in that portion 15 of the T-shaped hammer head 11 opposite the hammer end 12 thereof. In other words, the nail extractor 14 occupies the portion 15 of the hammer head 11 which is usually provided with a claw shape for pulling nails and is substituted therefor for that purpose. While the disclosure shows the nail extractor 14 as a part of a hammer head, it will be appreciated that the embodiment of the invention is basically in the form of an L-shaped tool 10 in which the extractor 14 is in the foot portion 15 of the L-shape in relation to the handle 13 or leg portion thereof.

DETAILED DESCRIPTION OF THE INVENTION

Referring to FIGS. 1, 2, and 3 of the drawing, the tool 10 has its foot portion 15 extending laterally from the handle 13 at an angle slightly less than normal and provided with an extreme outer surface 16 which is arcuate in contour at the juncture 17 of the foot with the handle. The foot portion 15 extends laterally as a solid member 18 of substantially square cross section and of sufficient length to assure a leverage action between it (the foot) and the handle 13. The foot portion 15 has a bore 19 formed therein from its outer end 20 toward the juncture 17 of the foot with the handle 13. The bore 19 formed in the member 18 is of a diameter to receive the flat head H of common nails N and/or spikes. The bore 19 extends inwardly from the outer end 20 of the member 18 a distance suitable to receive whatever portion of a nail extends from a surface S of a wooden member W or the like from which a nail is to be pulled.

The arcuate outer curved surface 16 on the foot of the L-shaped tool continues tangentially as at 21 along the laterally extending solid member 18 at a substantially greater radius to afford a rocker action to the foot portion 15 of the tool for reasons later to become apparent. The inner surface 22 of the foot portion opposite the curbed outer surface 21 thereof has a series of slits 23 formed therein. The slits 23 extend in toward communication with the bore 19 for receiving and engaging the head H of a nail N to be pulled. For nails having different lengths thereof projecting from a surface S from which the nail is to be pulled, several of such slits 23 are formed in spaced relation along the depth of the bore 19. In this manner, the head H of a nail N will lodge in one or another of such slits 23 with which the nail head H may be registered within the bore 19.

As best seen in FIG. 2, in order to pull a nail, the nail extractor tool 10 is positioned to present its outer end 20 facing the surface S from which a portion of the nail N protrudes. The tool 10 is then moved toward that portion of the nail N and the latter allowed to extend up into the bore 19 of the solid member 18. The handle 13 of the tool is then swung by hand anticlockwise (FIG. 2) about a rounded corner 25 of the member 18. The corner 25 is located between the outer end 20 and the tangent extended curved surface 21 of the member 18. The corner 25 thus acts as a fulcrum for first bending that portion of the nail N as at 26 around one margin of the open end of the bore 19 of the tool. It should be noted in FIG. 3 that the head end of the nail N bears against that side of the bore 19 into which the slits 23 extend. Consequently, regardless of how far the nail extends into the bore 19, its head end will lodge in one or another slit 23 during the first mentioned phase of the rocking movement of the tool. Moveover, it will be noted that the slits 23 may extend at a slight angle off normal to a line transverse to the bore 19. This is preferable, although not entirely necessary, to the angle of repose of the head end of the nail during the initial bending thereof as explained above.

With the extended portion of the nail N thus ensconced in the extracting tool 10, continued movement of the handle 13 is exherted anticlockwise with the arcuate outer surface 16 of the tool bearing upon the surface S of the member N from which the nail is to be pulled. By reason of the initial bend at 26 in the nail N, the major thrust of the outward pull upon the nail is not exherted entirely upon the head of the nail. Most of the upward pull is exherted by reason of the snubbing action created between the tool and the bend 26 in the nail. This assures complete extraction of the nail without distorting the head of the nail which might ordinarily occur.

The nail snubbing action feature of the present invention is particularly useful in the extraction of finishing nails F as depicted in FIGS. 5 and 6 of the drawing. Referring again to FIG. 1 of the present disclosure, it will be noted that the bore 19 is offset relative to the side faces 27 and 28 of the solid member 18 of the foot portion 15. A second bore 29 is formed in the solid member 18 from its outer end 20 in parallelism with the bore 19 as shown in FIGS. 4, 5, and 6. This bore 29 need not necessarily be formed therein such as to communicate with the slits 23. It is preferable, however, that the outer end 20 of the foot portion 15 have a groove 30 formed therein. The groove 30 extends between the outer and inner surfaces 21 and 22 of the member 18. When the exposed end of a finishing nail to be pulled is inserted into the bore 29, the base of the groove 30 is disposed inwardly of the face 20, which rest upon the surface S. The finishing nail F therefore begins to bend as at 36 promptly upon anticlockwise movement of the tool handle 13 relative to the surface S and the outer surface 20 of the tool away from the surface S as illustrated in FIG. 6. This creates the snubbing action between the tool and the nail F. Further bending of the nail F ultimately causes the shank of such nail to lodge in the groove 30 as illustrated in FIG. 7 after the nail F is completely extracted. In either case, the bend in the nail at the mouth of the bore prevents accidental flipping of the head portion out of the bore when the nail is suddenly withdrawn from the member W.

Having this described my nail extractor in specific detail, it will be appreciated by those skilled in the art that it may be susceptible to variations, modifications and/or alterations without departing from the spirit or scope of my invention there as called for in the appended claims.

I claim:

1. A nail extracting tool for pulling nails having a head portion extending from a surface below which the balance of such nail is embedded comprising:

1. a handle;
2. a solid member extending laterally from one end of said handle;
3. a bore formed in said solid member from the free end thereof toward said handle for receiving that portion of a nail extending from and to be extracted from such surface;
4. said solid member having an arcuate contour on its extreme outer face adapted to engage the surface from which the nail is to be pulled;
5. a fulcrum corner between said outer face and the free end of said solid member for initially bending the shank of such nail at the open end of said bore during manipulation of said handle by movement thereof about said fulcrum corner and to thereby create a snubbing action between such nail and the solid member during continued movement of the arcuate outer face of the latter relative to the surface from which the nail is to be extracted; and
6. a slit formed in said solid member from that face thereof opposite its arcuate outer face into communication with the bore formed in said member for receiving the head of a nail disposed in the bore during the initial bending of the shank of such nail.

2. The nail extracting tool in accordance with that of claim 1 including a series of said slits formed in spaced relation along the length of said solid member for registering with the head of a nail in one of said slits in said bore dependent upon the length and disposition of the head of the nail within the bore.

3. The nail extracting tool in accordance with that of claim 1 in which said slit is formed at an angle slightly off normal to the axis of the bore to register with the inclination of the head of a nail therein during the initial bending of the shank of the nail.

* * * * *